US010758771B1

(12) United States Patent
Cranke

(10) Patent No.: US 10,758,771 B1
(45) **Date of Patent: *Sep. 1, 2020**

(54) SPORTS TRAINING SYSTEM AND METHOD

(71) Applicant: Christopher T. Cranke, Upper Marlboro, MD (US)

(72) Inventor: Christopher T. Cranke, Upper Marlboro, MD (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/103,627

(22) Filed: Aug. 14, 2018

Related U.S. Application Data

(63) Continuation-in-part of application No. 15/475,019, filed on Mar. 30, 2017, now Pat. No. 10,245,459.

(60) Provisional application No. 62/545,153, filed on Aug. 14, 2017.

(51) Int. Cl.

| | |
|---|---|
| ***A63B 21/00*** | (2006.01) |
| ***A63B 21/055*** | (2006.01) |
| ***A63B 23/04*** | (2006.01) |
| ***A63B 21/02*** | (2006.01) |

(52) U.S. Cl.
CPC ..... *A63B 21/4025* (2015.10); *A63B 21/0557* (2013.01); *A63B 21/4009* (2015.10); *A63B 21/4015* (2015.10); *A63B 21/028* (2013.01); *A63B 23/04* (2013.01)

(58) Field of Classification Search
CPC ..... A63B 21/02; A63B 21/04–0407; A63B 21/0428; A63B 21/055–0557; A63B 21/4001; A63B 21/4009; A63B 21/4013–4015; A41D 2200/10; A41F 9/00–005
See application file for complete search history.

(56) References Cited

U.S. PATENT DOCUMENTS

| | | | | | |
|---|---|---|---|---|---|
| 2,097,376 | A * | 10/1937 | Marshman | A63B 21/0004 | 482/124 |
| 5,203,754 | A * | 4/1993 | Maclean | A63B 21/0004 | 482/121 |
| 5,716,307 | A * | 2/1998 | Vadher | A43B 7/20 | 482/124 |
| 7,744,511 | B2 * | 6/2010 | Grigoriev | A61F 5/0102 | 482/121 |
| 7,874,970 | B2 * | 1/2011 | Glisan | A63B 21/0552 | 482/124 |
| 9,186,536 | B2 * | 11/2015 | Strachan | A63B 21/0557 | |

(Continued)

*Primary Examiner* — Jennifer Robertson

(74) *Attorney, Agent, or Firm* — QuickPatents, LLC; Kevin Prince

(57) ABSTRACT

A physical training system includes a belt for fixing around the waist of a person and that includes a plurality of belt extension straps each adapted for fixing with the belt at any location therearound and preferably adjustable in length. Two shoes are adapted for wearing on the person's feet, each shoe including at least four attachment loops at opposing quadrants of the shoe and optional shoe extension straps. A plurality of elastomeric bands are selectively fixable between any of the belt extensions straps and the attachment loops or shoe extension straps of the shoes. A shoulder harness comprising two straps is included for attachment to and positioning of the belt. As such, in use, the person while running experiences resistance as each leg extends into a fully extended position, and a reduction or cessation of resistance as each leg retracts into a non-extended position.

22 Claims, 13 Drawing Sheets

(56) References Cited

U.S. PATENT DOCUMENTS

| | | | | |
|---|---|---|---|---|
| 9,192,806 | B2 * | 11/2015 | Mial | A63B 21/0407 |
| 2002/0068667 | A1 * | 6/2002 | Strachan | A63B 21/0004<br>482/124 |

* cited by examiner

SPORTS TRAINING SYSTEM AND METHOD

CROSS-REFERENCE TO RELATED APPLICATIONS

This application is a Continuation-in-Part of U.S. Utility patent application Ser. No. 15/475,019 filed on Mar. 30, 2017, and further claims the benefit of U.S. Provisional Application 62/545,153, filed on Aug. 14, 2017, both hereby incorporated herein by reference.

STATEMENT REGARDING FEDERALLY SPONSORED RESEARCH AND DEVELOPMENT

Not Applicable.

FIELD OF THE INVENTION

This invention relates to sports training devices, and more particularly to a sports training device and method.

DISCUSSION OF RELATED ART

Exercise and physical training devices are replete in the prior art. With the advent relatively inexpensive and durable resistance band materials, resistance band exercising devices are becoming more popular. Several prior art resistance band exercising devices are disclosed in such prior art references as: US 2017/0028244 to Schreiber et al. on Feb. 2, 2017; US 2006/0265910 to Lampley on Nov. 30, 2016; and my previous patent applications 2013/0333097 published on Dec. 19, 2013; US 2012/0283077 Published on Nov. 8, 2011; US 2015/0057135 published on Feb. 26, 2015; and 2016/0101309 published on Apr. 14, 2016. None of these prior art devices teaches or suggests resistance that not only decreases as a person's leg retracts but that also can be set to cease or cut-off at a certain point in the travel of the leg, minimizing strain on ancillary or non-primary muscles. Further, none of the prior art devices allows for a wide range of connection points with the shoe that maximizes the number of different exercises and drills that can be performed. None of the prior art devices includes resistance adjustments both at the lower and upper ends of the resistance bands.

Therefore, there is a need for a physical training system that allows for the resistance applied to a person's legs to be reduced to zero or nearly zero at any adjustable point along the path of leg travel of the exerciser. Such a needed device would further allow a wide range of possible connection points between the person's torso and shoes, and would include adjustments for the length and resulting resistance between the top and bottom ends of each resistance band. The present invention accomplishes these objectives.

SUMMARY OF THE INVENTION

The present device is a physical training system for use by a person, such as an athlete or exerciser, that includes a belt adapted for fixing around the waist of the person. Preferably the belt includes a loop-type fastening material on both an inside surface and an outside surface thereof. A cooperative hook-type fastening material is fixed with the inside surface of the belt at a first end and an opposing second end. The belt also preferably includes a buckle mechanism adapted to receive the first and second ends, of the belt therethrough.

The belt includes a plurality of belt extension straps that each have a belt connecting mechanism at a top end thereof and a connection loop at a bottom end thereof. Each belt extension strap is adapted for fixing with the belt at any location therearound and preferably includes a length adjustment mechanism.

Two shoes are adapted for wearing on the person's feet, each shoe including at least four attachment loops at opposing quadrants of the shoe, and preferably a rear attachment loop and additional attachment loops around the inner and outer edges.

A plurality of elastomeric bands are selectively fixable between the connection loop of any of the belt extensions straps and the attachment loops of the shoes.

A shoulder harness having a pair of shoulder straps is included, each connectable with the belt at opposing ends of the shoulder strap. Each shoulder strap has at least one of the connection loops and rigid rings, and preferably includes at least one shoulder pad having at least one slot formed therethrough for receiving the shoulder strap therethrough. Each shoulder pad is thereby adjustable along the shoulder strap.

Each shoulder strap includes the loop-type fastening material on both an inside surface thereof and an outside surface thereof, and the cooperative hook-type fastening material on an inside surface thereof at a first end thereof, whereby the first end and a second end of each shoulder strap can be looped around the belt and positioned as desired on the person's torso, a vertical position of the belt on the person being established thereby.

At least one set of position straps are preferably included that can be fixed at any location along either one of the shoulder straps or the belt to indicate a proper adjustment position of one of the shoulder straps or the belt for the person. The position straps in each set are all of a common color, with the color the position straps of each set being unique for each person sharing the physical training system. As such one person knows where to position the buckle mechanism and/or length of the shoulder straps prior to use.

In preferred embodiments, the physical training system further includes a plurality of shoe extension straps each fixable at an upper end thereof with the second end of any of the elastomeric bands, and selectively fixable at a lower end thereof with any of the attachment loops of either shoe. At least one of the shoe extension straps preferably further includes a second length adjustment mechanism, such as a buckle mechanism. As such, in use, with the person wearing the belt and shoes, and with the plurality of elastomeric bands stretched between the connection loops of the belt extensions straps and the attachment loops of the shoes, the person while walking or running experiences resistance as each leg extends into a fully extended position. Conversely, the person experiences a reduction or cessation of resistance as each leg retracts into a non-extended position.

In preferred embodiments, the physical training system further includes a plurality of shoe extension straps each fixable at an upper end thereof with either end of any of the elastomeric bands, and selectively fixable at a lower end thereof with any of the attachment loops of either shoe. At least one of the shoe extension straps preferably further includes a second length adjustment mechanism.

As such, in use, with the person wearing the belt and shoes, and with the plurality of elastomeric bands stretched between the connection loops of the belt extensions straps and the attachment loops of the shoes, the person while walking or running experiences resistance as each leg extends into a fully extended position. Conversely, the person experiences a reduction or cessation of resistance as each leg retracts into a non-extended position.

Preferably each attachment loop of each shoe includes a strap member fixed at a lower end thereof with the shoe, preferably with a strap member attachment mechanism such as the hook-and-loop type fastening material, mechanical snaps, mechanical buckle mechanisms, or the like. An upper end of each strap member terminates in a loop that is adapted for selective fixing with an end of any of the elastomeric bands.

In some embodiments, the attachment loop and any associated strap member are color-coded so that the person knows which attachment loops to use for particular exercises. Further, a rigid metal or plastic ring may be included that traverses the connection loop of each belt extension strap for facilitating the connection of the connection loop with any of the elastomeric bands. In some embodiments, such a rigid ring may also be included traversing one or more of the attachment loops of each shoe. Preferably each end, of the elastomeric bands includes a selectively removable hook adapted for fixing with any of the attachment loops of the shoes, the connection loops of the belt extension straps, or the upper ends of the shoe extension straps.

In some embodiments the belt further includes a buckle cover having the hook-type fastening material on an inside surface thereof and adapted for fixing with the belt to cover the buckle mechanism. Such a buckle cover further includes the loop-type fastening material on an outside surface thereof, such that each belt extension strap may be fixed with the belt at the buckle cover, either on one side of the belt or another, or on both.

The present invention is a physical training system that allows for the resistance applied to a person's legs to be reduced to zero at any adjustable point along the path of leg travel of the exerciser. The present device further allows a wide range of possible connection points between the person's torso and shoes, and provides for adjustments to the length and resulting resistance between the top and bottom ends of each resistance band. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
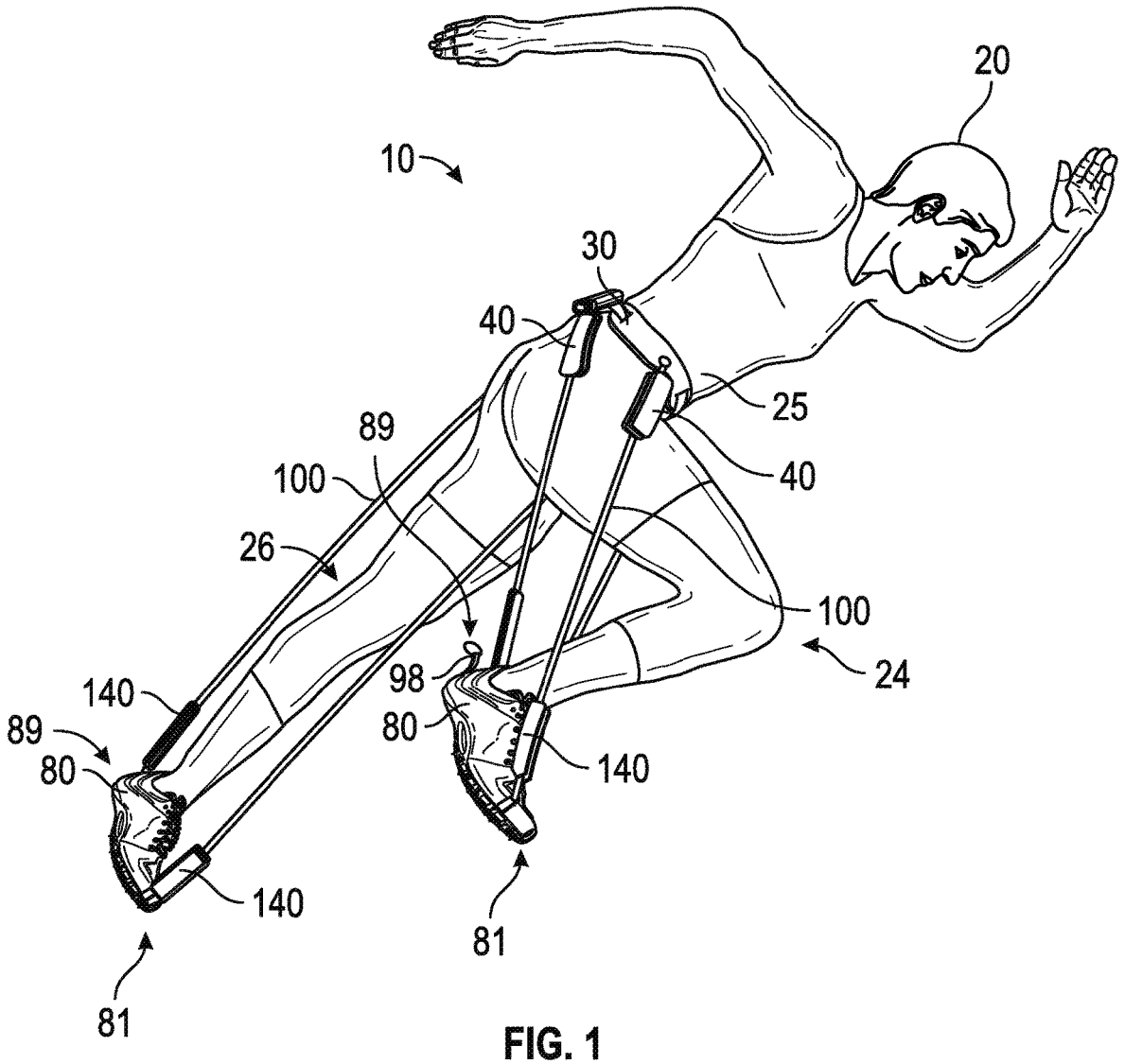
FIG. 1 is a side elevational view of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4, 8 and 9 illustrate a physical training system 10 for use by a person 20, such as an athlete or exerciser. The physical training system 10 provides additional resistance for exercises such as walking, jogging, running, and various leg and balance exercises, as well as some arm and upper body exercises.

A belt 30 is adapted for fixing around the waist 25 of the person 20. The belt 30 is preferably resilient and includes an internal resilient stiffener 190 (FIG. 7) within an outer flexible nylon or polypropylene fabric or web sleeve 31 of the belt 30 to aid in maintaining the belt 30 in a circular shape while in-use. Alternately, the belt 30 is made from a resilient material such as a resilient plastic or rubber material.

Figure 5:
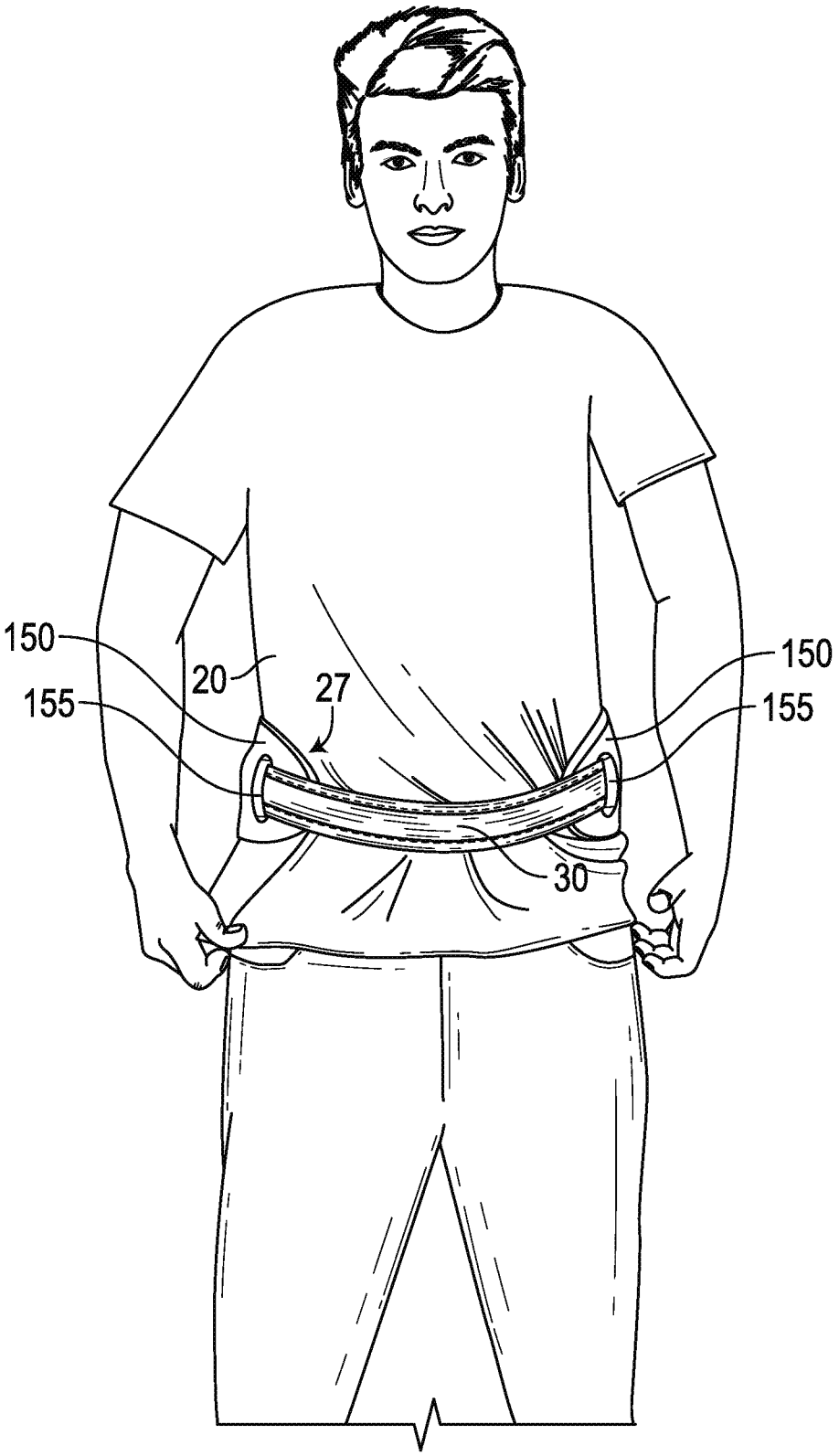
FIG. 5 is a front elevational view of a belt and hip pads of the invention.

Preferably the belt 30 further includes at least two hip pads 150 (FIG. 5) that each have at least one slot 155 therethrough adapted for receiving the belt 30 therethrough. As such, with the belt 30 inserted into each of the slots 155, each hip pad 150 may be adjusted to any location around the belt 30 to cushion forces on the person's hips 27 that pull down on the belt 30 during use. Such hip pads 150 are preferably made from a resilient foam material, or the like.

Preferably the belt 30 includes a loop-type fastening material 160 (FIG. 7) on both an inside surface 34 and an outside surface 36 thereof. A cooperative hook-type fastening material 170 is fixed with the inside surface 34 of the belt 30 at a first end 32 and an opposing second end 38. The belt 30 also preferably includes a buckle mechanism 35 adapted to receive the first and second ends 32,38 of the belt 30 therethrough.

As such the person 20 may initially fit the belt around his waist 25 and then set the ends 32,34 of the belt 30 for a snug but comfortable fit. Thereafter the buckle mechanism 35 may be selectively separated mechanically to quickly unfasten or re-fasten the belt 30. As a person's waist size changes he can separate one or more of the ends 32,38 from the inside surface 34 of the belt 30 to make an adjustment to the diameter of the belt 30 around his waist 25. The person 20 may wear the belt 30 with the buckle mechanism in the back (FIG. 5) or in the front (FIG. 8), as desired.

Figure 2:
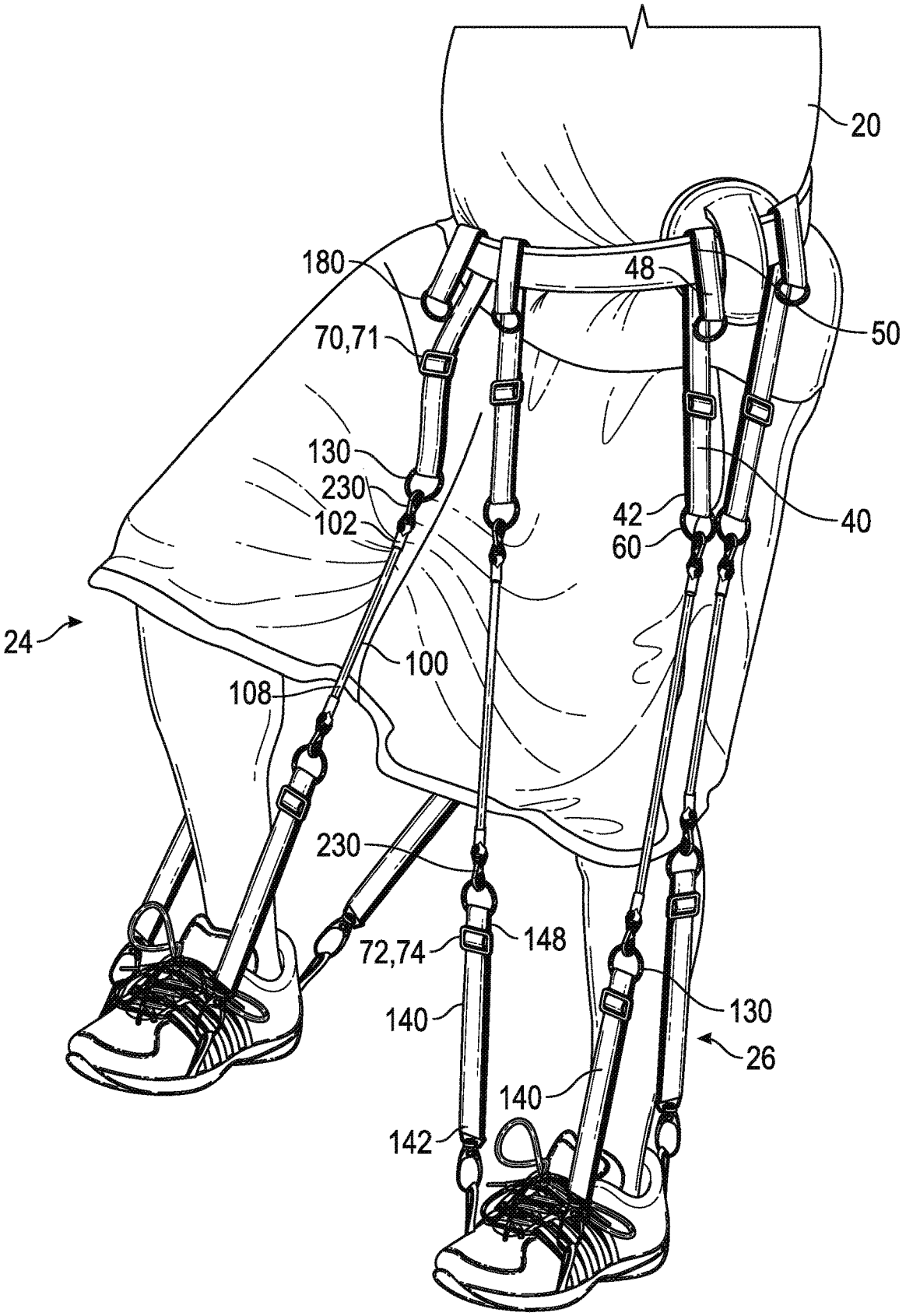
FIG. 2 is a perspective view of the invention.
Figure 3:
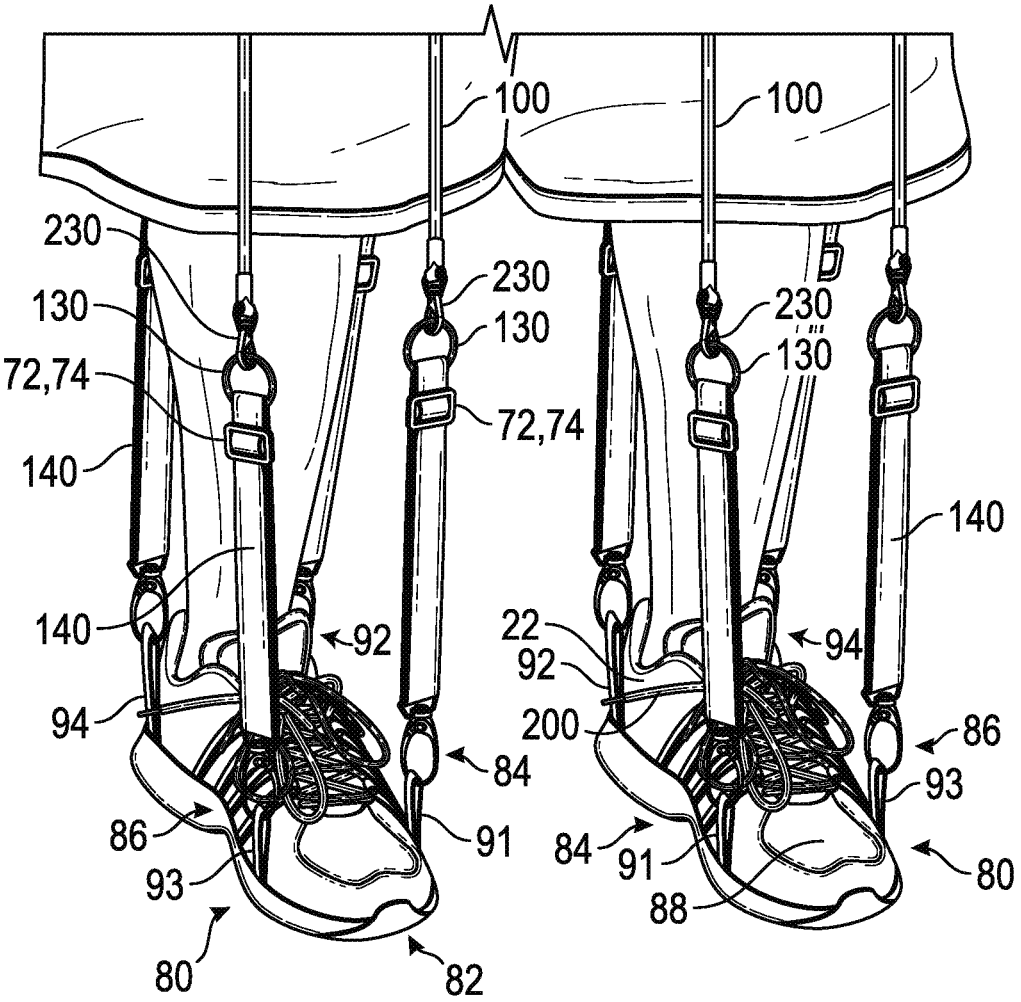
FIG. 3 is a front-perspective view of shoes and shoe extension straps of the invention.
Figure 4:
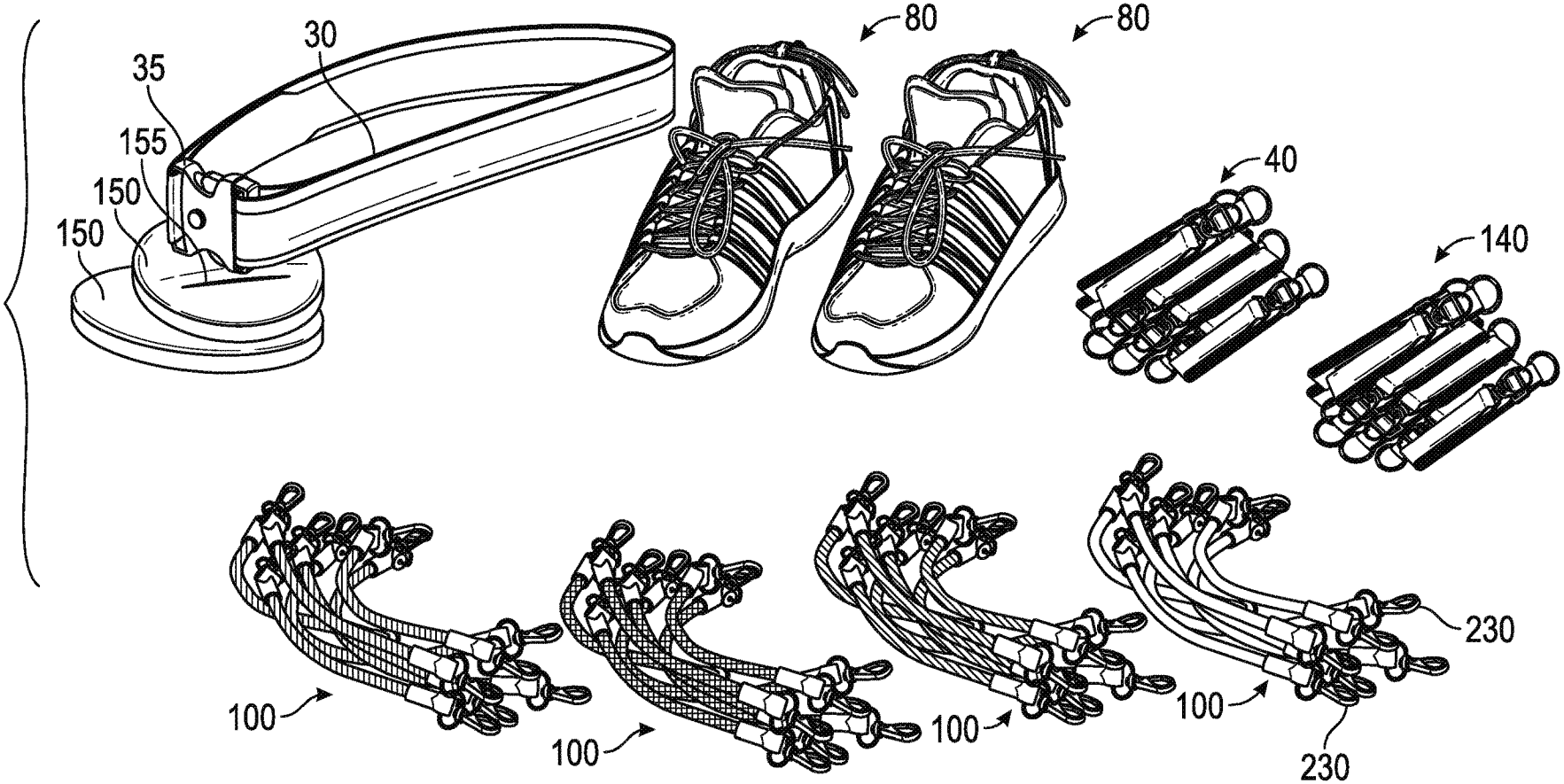
FIG. 4 is a perspective view of some of the component parts of the invention, resistance bands thereof shading for different colors.
Figure 7:
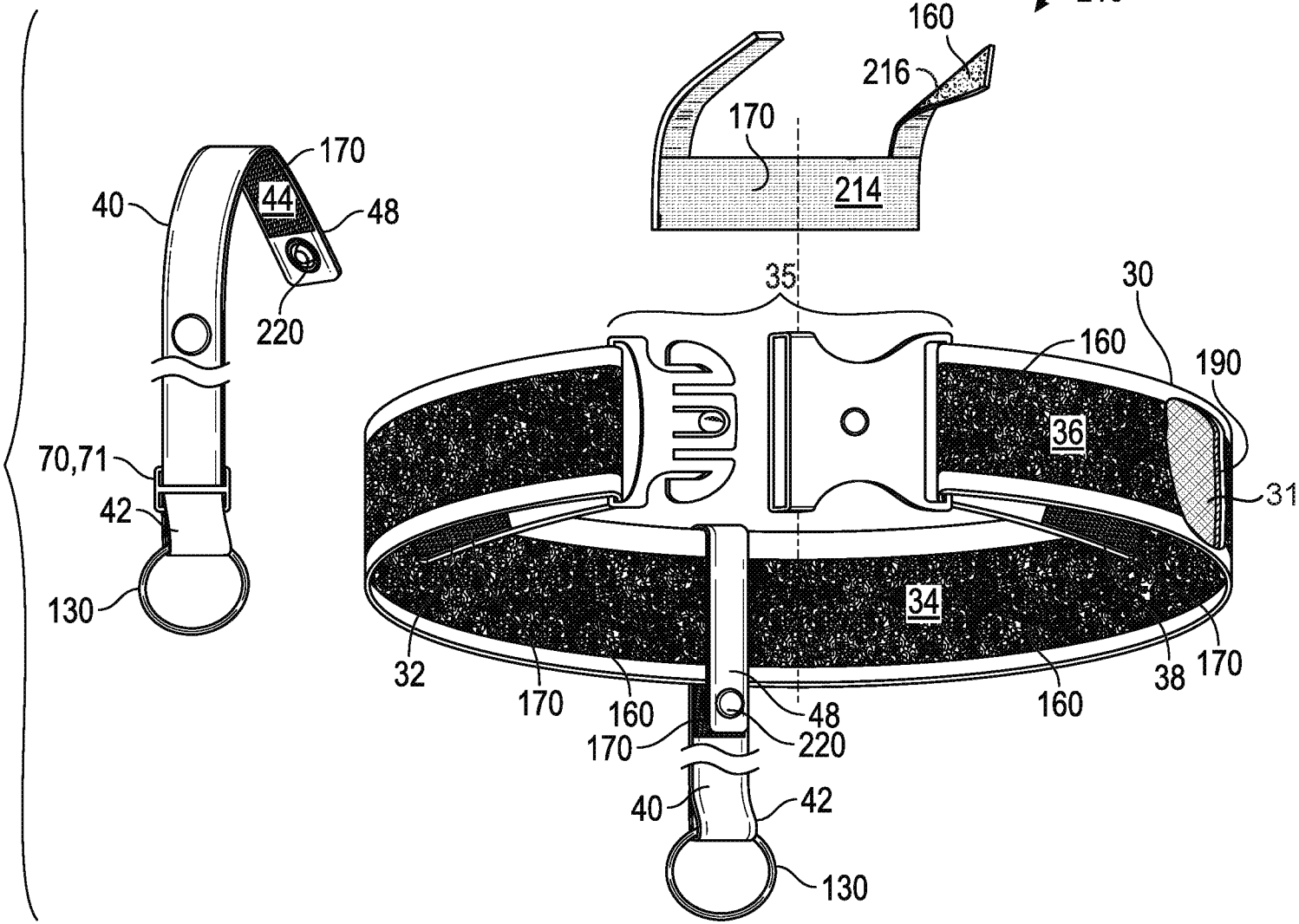
FIG. 7 is an exploded, partially cut-away perspective view of the belt and belt extension straps of the invention.

The belt 30 includes a plurality of belt extension straps 40. In some embodiments, each belt extension strap 40 includes a belt connecting mechanism 50 (FIG. 2) at a top end 48 of the belt 40 and a connection loop 60 at a bottom end 42 of the belt 40. Each belt extension strap 40 is adapted for fixing with the belt 30 at any location therearound and preferably includes a length adjustment mechanism 70, such as a buckle mechanism 71 (FIG. 2). The belt connecting mechanism 50 at the top end 48 of each belt extension strap 40 preferably includes the hook-type fastening material 170 on an inside surface 44 thereof, which is adapted for fixing about the loop-type fastening material 160 on the inside surface 34 and on the outside surface 36 of the belt 30 to fix the belt extension strap 40 at a desired location on the belt 30 (FIG. 7).

Figure 10A:
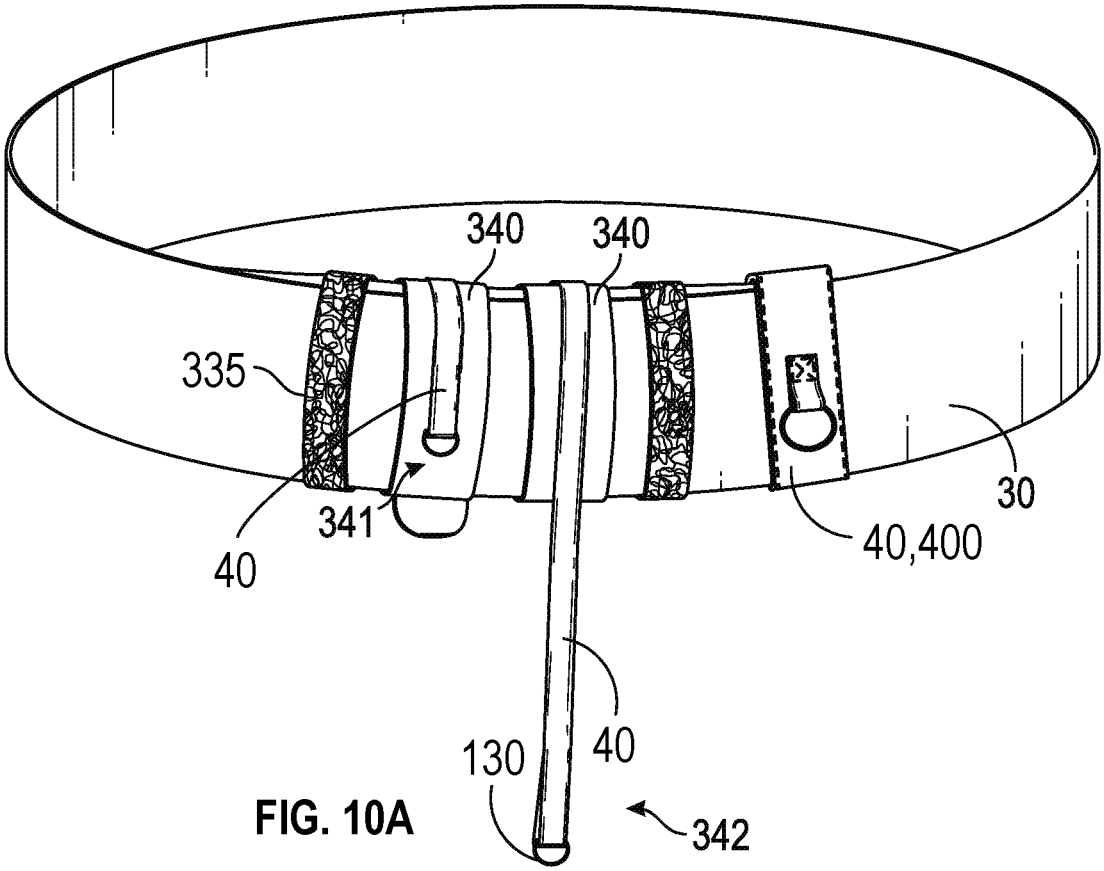
FIG. 10A is a partial perspective view of the belt and two alternate embodiments of the belt extension straps.
Figure 10B:
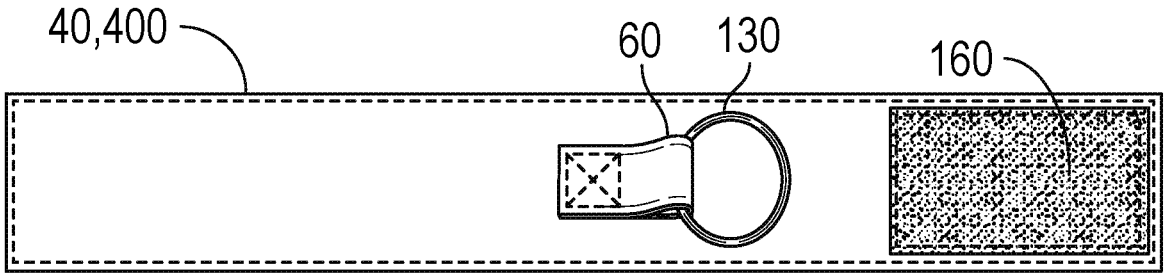
FIG. 10B is a front view of an alternate embodiment of the belt extension strap.
Figure 10C:
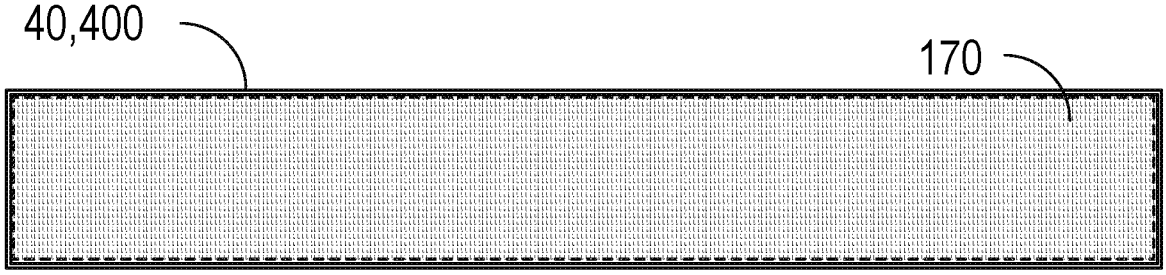
FIG. 10C is a rear view of the belt extension strap of FIG. 10B.

In some embodiments the belt extension strap 40 takes the form of an alternate extension strap 400 (FIGS. 10B, 10C) that includes one of the connection loop 60 fixed to a central portion of the extension strap 40, includes the loop-type fastening material 160 at one end, and does not include the buckle mechanism 71, such that the extension strap 40 can be looped around the belt 30 and its own opposing ends to affix to the belt 30 at a desired location. Preferably each belt extension strap 40 is made from a nylon strap or webbing material, or the like.

In some embodiments of the invention, the belt 30 and any of the belt extension straps 40 may further include an auxiliary tension ring 180 fixed therewith, such that external lateral forces may be applied to the auxiliary tension ring 180 to further enhance the physical training of the person 20. For example, a coach may attach a strap or rope (not shown) to one or more of the auxiliary tension rings 180 to pull against the person 20 walking away from the coach. In alternate embodiments the belt extension strap 40 is fixed to a belt extension fastener 340 (FIG. 10A) that is adapted for fixing with the belt 30, the length of the belt extension strap 40 being sufficient to loop around the inside surface 34 of the belt 30 to present a first length 341 to the person 20, and when not looped around the belt 30 presenting a second length 342 to the person 20.

Two shoes 80 are adapted for wearing on the person's feet 22, each shoe 80 including an outer side 86, an inner side 84, a rear end 89, a front end 81, a top side 88, and a bottom side 82. Each shoe 80 includes at least four attachment loops 90 that include an inner/front attachment loop 91 attached with the shoe 80 proximate the front end 81 of the shoe 80 on the inner side 84 thereof, an inner/rear attachment loop 92 attached with the shoe 80 proximate the rear end 89 of the shoe 80 on the inner side 84 thereof, an outer/front attachment loop 93 attached with the shoe 80 proximate the front end 81 of the shoe on the outer side 86 thereof, and an outer/rear attachment loop 94 attached with the shoe 80 proximate the rear end 89 of the shoe 80 on the outer side 86 thereof. Each shoe may further include a rear attachment loop 98, and other attachment loops 40 as necessary for providing multiple physical training options as discussed below. Such shoes 80 are preferably made with materials well-known in the art for running shoes, tennis shoes, track shoes, or the like. While the term "shoe" is used herein, it is understood that "shoe" could mean any type of footwear or article that is attached to footwear either permanently or temporarily. In some embodiments the shoe 80 can take the form of a shoe cover (not shown) that is worn over an existing shoe and that includes the attachment loops 90.

Figure 14:
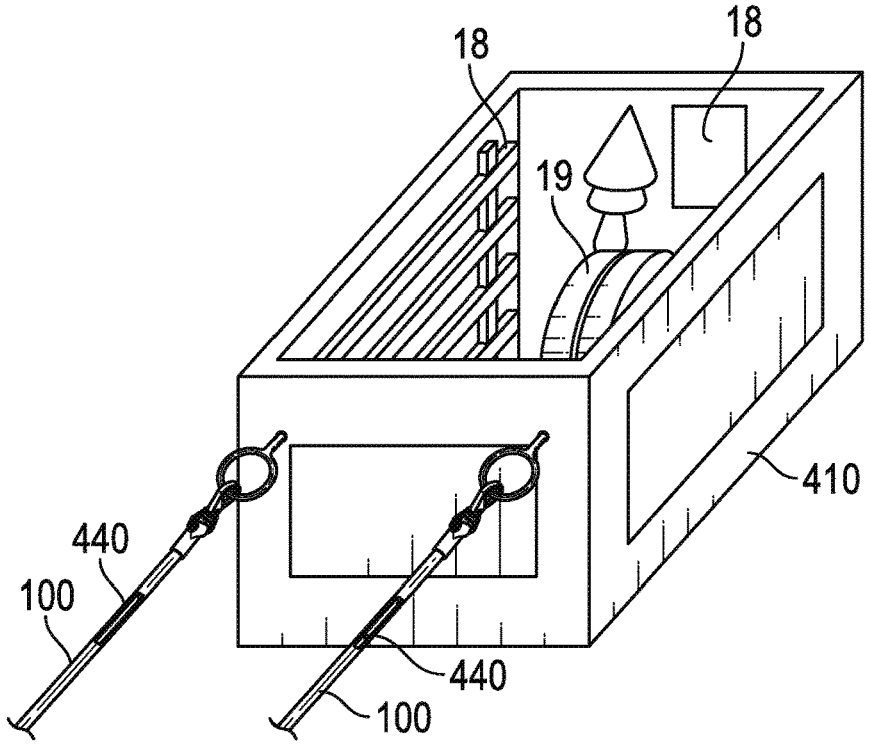
FIG. 14 is a partial perspective view of a container of the invention, illustrated while holding items such as weights and being dragged by a pair of the elastomeric bands.

A plurality of elastomeric bands 100 each have a first end 102 and an opposing second end 108. The first end 102 of each elastomeric band 100 is selectively fixable with the connection loop 60 of any of the belt extensions straps 40. Similarly, the second end 108 of each elastomeric band 100 is selectively fixable with any of the attachment loops 90 of the shoes 80. Some of the elastomeric bands 100 may be made with different elasticities than other of the elastomeric bands 100, and preferably all elastomeric bands 100 having common elasticities have the same color or indicia 440 (FIG. 14), allowing the person 20 to easily differentiate between elastomeric bands 100 having different elasticities. Some of the elastomeric bands 100 may be made having different lengths (not shown) to accommodate people of different heights or ages. The elastomeric bands 100 are preferably made with an elastomeric rubber material, a coiled spring material, or the like.

Figure 9:
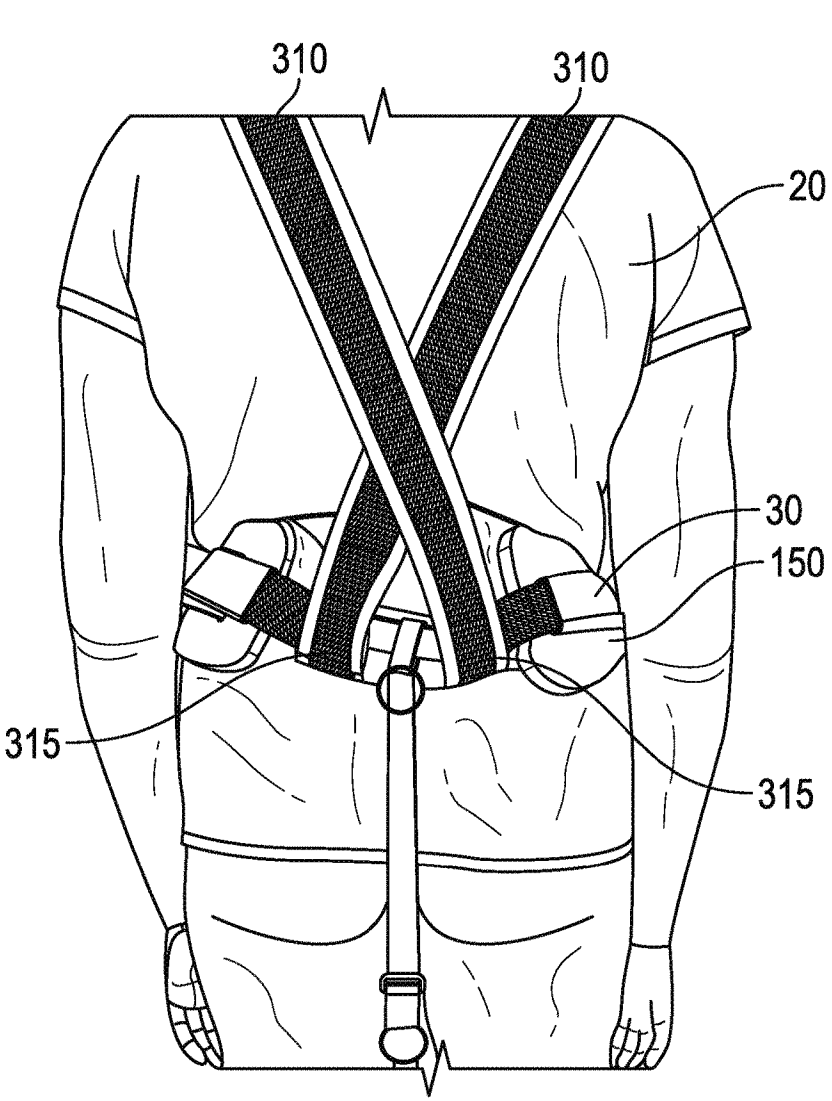
FIG. 9 is a partial rear view of FIG. 8.
Figure 8:
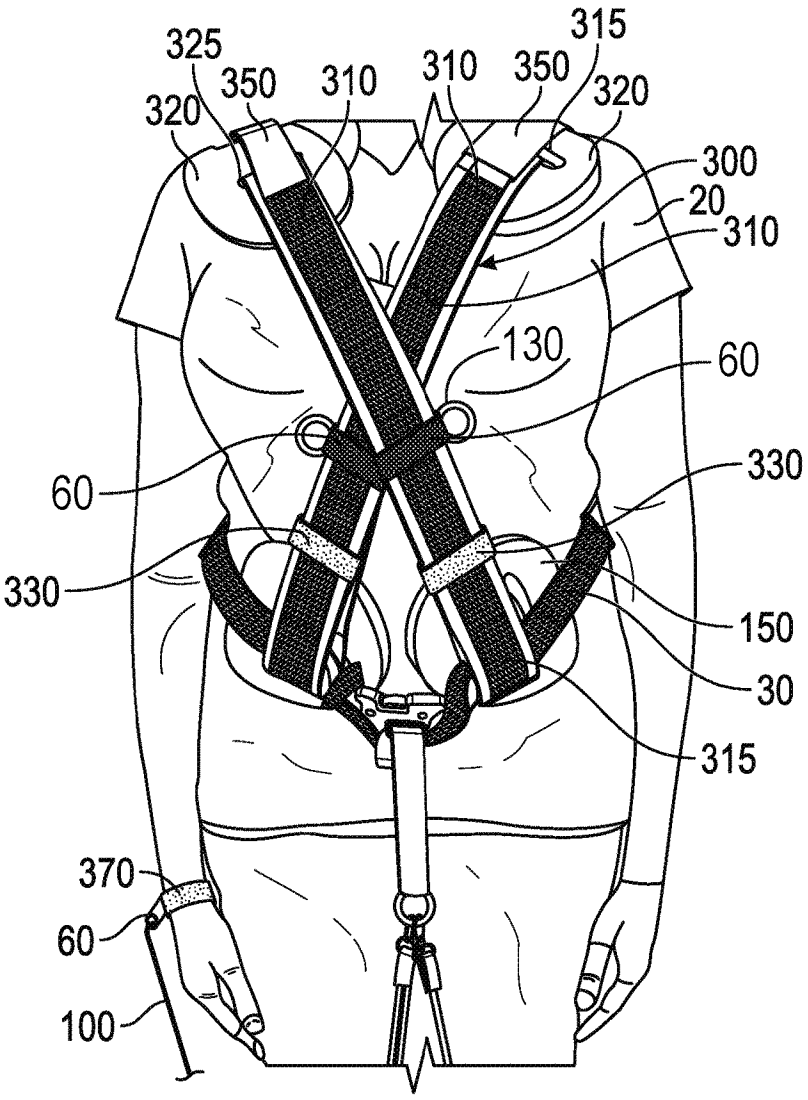
FIG. 8 is a partial front view of a shoulder harness of the invention.
Figure 11:
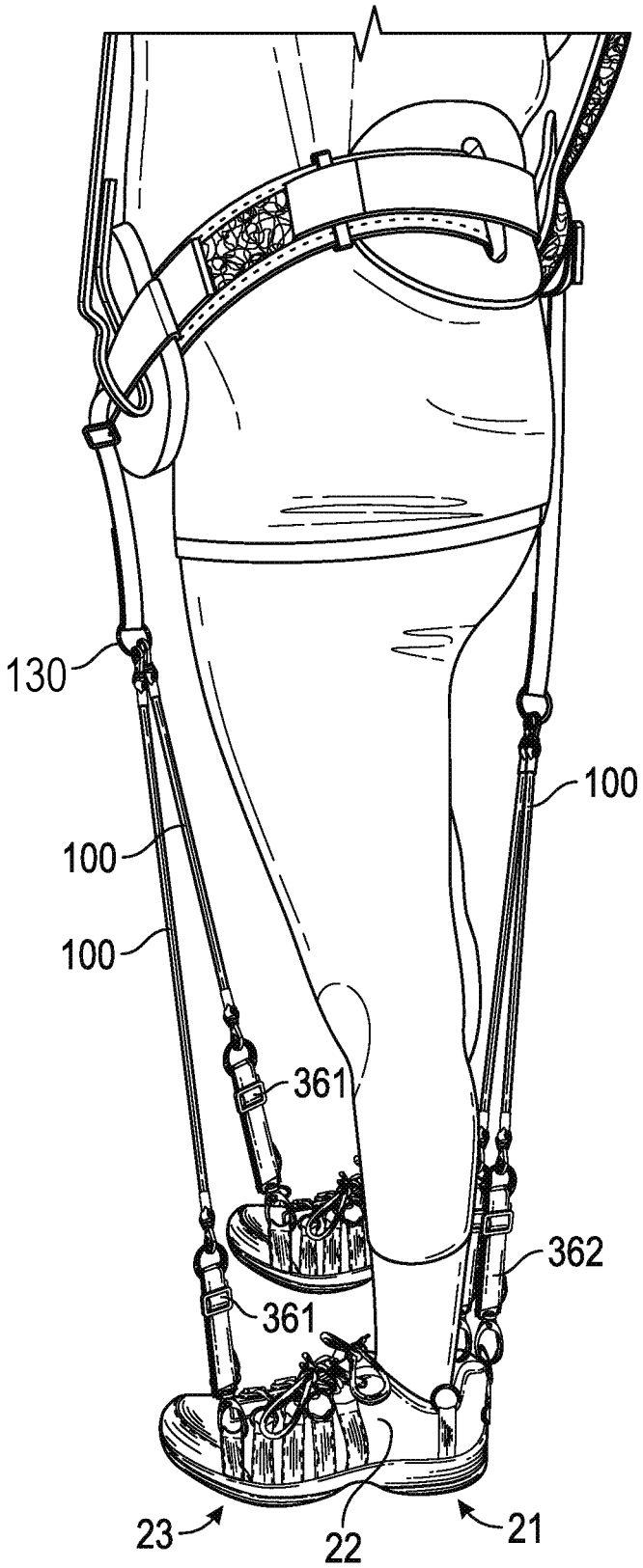
FIG. 11 is a partial perspective view of the invention, illustrated with a short shoe extension strap and a long shoe extension strap.

FIGS. 8, 9 and 11 illustrate a shoulder harness 300 having a pair of shoulder straps 310, each connectable with the belt 30 at opposing ends 315 of the shoulder strap 310. Each shoulder strap 310 has at least one of the connection loops 60 and one rigid, preferably metal ring 130, and preferably includes at least one shoulder pad 320 having at least one slot 325 formed therethrough for receiving the shoulder strap 310 therethrough. Each shoulder pad 320 is thereby adjustable along the shoulder strap 310. Each shoulder strap 310 is made from a nylon strap or webbing material, or the like, and each shoulder pad 320 is preferably made from a resilient foam material or the like.

Each shoulder strap 310 preferably includes the loop-type fastening material 160 on both an inside surface thereof and an outside surface thereof, and the cooperative hook-type fastening material 170 on an inside surface thereof at a first end thereof, whereby the first end and the second end of each shoulder strap 310 can be looped around the belt 30 and positioned as desired on the person's torso, a vertical position of the belt 30 on the person being established thereby. The alternate belt extension straps 400 (FIGS. 10A-10C) may also be attached to such a shoulder strap 310. A logo strap 350 (FIG. 8) having the hook-type fastening material on a bottom side thereof may be placed along either shoulder strap 310 for displaying a logo or other indicia (not shown).

FIG. 8 illustrates a pair of position straps 330, each strap 330 adapted to be fixed at any location along either one of the shoulder straps 310 or the belt 30 to indicate a proper adjustment position of one of the shoulder straps 310 or the belt 30 for the person 20. Such position straps 330 mark the custom location, by person 20, on the belt 30 or shoulder strap 310 to adjust the length thereof. The position straps 330 in each set are all of a common color, with the color the position straps 330 of each set being unique for each person sharing the physical training system 10. As such one person 20 knows where to position the buckle mechanism 35 and/or length of the shoulder straps 310.

Similarly, a plurality of strap keepers 335 (FIG. 10A), such as straps of the hook-and-loop type fastening material 160,170, can be included to secure the ends 35 of the belt 30 in place, or the ends 315 of the shoulder straps 310 in place, and prevent their becoming dislodged from the belt 30 or shoulder strap 310 during use.

The shoulder straps 310 cross at the back of the person 20 but can be substantially parallel as they are looped over the shoulders of the person 20 in the front (as is typical for use by a man), or crossed once at the front (as is typical for use by a woman), as illustrated in FIGS. 8 and 9, depending on the comfortable use thereof by the person 20.

In preferred embodiments, the physical training system 10 further includes a plurality of shoe extension straps 140 each fixable at an upper end 148 thereof with the second end 108 of any of the elastomeric bands 100, and selectively fixable at a lower end 142 thereof with any of the attachment loops 90 of either shoe 80, or directly to the shoe 80 itself through stitching or other means, in which case the top end of the shoe extension strap takes the form preferably of one of the connection loops 60 with or without the rigid ring 130. At least one of the shoe extension straps 140 preferably further includes a second length adjustment mechanism 72, such as a buckle mechanism 74 (FIGS. 2 and 7). In such an embodiment an elastomeric or malleable keeper strap (not shown) is included for retaining extra length of the shoe extension strap 140 to prevent same from flapping around during running or jogging. Some of the shoe extension straps 140 can be made of a resilient rubber material, a rigid material, or the like.

As such, in use, with the person wearing the belt 30 and shoes 80, and with the plurality of elastomeric bands 100 stretched between the connection loops 60 of the belt extensions straps 40 and the attachment loops 90 of the shoes 80, the person 20 while walking or running experiences resistance as each leg extends into a fully extended position 26. Conversely, the person 20 experiences a reduction or cessation of resistance as each leg retracts into a non-extended position 24. Preferably one of the connection loops 60 is positioned anteriorly on the belt 30 for use with the elastomeric bands 100 that terminate at the front end 81 of the shoes 80, and preferably one of the connection loops 60 is positioned posteriorly on the belt 30 for use with the elastomeric bands 100 that terminate at the rear end 89 of the shoes 80.

Based on the exercise to be done, such as jogging, for example, the person 20 can adjust the belt extension straps 40 and shoe extension straps 140 such that the resistance bands 100 are just taut when the person's knee is at a top point in his stride. Preferably the front-most attachment loops 91,93 can be used to connect the resistance bands 100 with a forward part of the belt 30, and the rear-most attachment loops 92,94 can be used to connect the resistance bands 100 to a rearward part of the belt 30. The two front-most attachment loops 91,93 may be connected to a single resistance band 100 via two of the shoe extension straps 140, the two shoe extension straps 140 forming an inverted V-shape (not shown).

Alternately, for use with, for example, physical therapy applications, the resistance bands 100 and/or shoe extension straps 140 connect with the shoes 80 closer to a central location along the inner and outer sides 89,86 of the shoes 80, and the belt extension straps 40 and shoe extension straps 140 are adjusted such that the resistance bands 100 are just taut when the person's knee is only slightly raised. This would provide minimal resistance to those who are learning how to walk again after an accident, for example.

Alternately, for strenuous and rapid directional-changing exercises, such as the so-called "three-cone" drill performed by professional football players during practice, the person 20 can adjust the belt extension straps 40 and shoe extension straps 140 to tighten-up the resistance bands 100 to provide more resistance through a greater range of leg motion. For such an exercise the resistance bands 100 and/or shoe extension straps 140 connect with the shoes 80 closer to a central location of the shoe 80 along the inner and outer sides 89,86 thereof.

Preferably a short shoe extension strap 361 (FIG. 11) is included for connecting with the front most connection loops 91, 93 of the shoe 80, while long shoe extension straps 362 are fixed with the opposing rear attachment loop 92 attached with the shoe 80 proximate the rear end 89 of the shoe 80. As such, when the person 20 is walking the elastomeric bands 100 connected to the short shoe extension strap 361 except more force on the front end 81 of the shoe 80 than on the rear end 89 of the shoe 80, such that the person 20 is encouraged to land each foot on a ground surface at the heal 21 of his foot 22. Accordingly, the short and long shoe extension straps 361,362 may be swapped to encourage the person 20 to land each foot 22 on the ground surface at the balls 23 of his foot 22.

Preferably each attachment loop 90 of each shoe 80 includes a strap member 110 fixed at a lower end 112 thereof with the shoe 80, preferably with a strap member attachment mechanism 220 such as the hook-and-loop type fastening material 160,170, mechanical snaps, mechanical buckle mechanisms, or the like. An upper end 118 of each strap member 110 terminates in a loop 120 that is adapted for selective fixing with the second end 108 of any of the elastomeric bands 100. Such a plurality of strap members 110, when not in use for physical training of the person 20, may be cinched together with a conventional shoelace 200 to further aid in keeping the shoe 80 in place on the person's foot 22. Alternately, each strap member 110 may be fixed to the shoe with a two-part mechanical fastener (not shown) such as the hook-and-loop fastening material, magnets, mechanical snaps, or the like.

In some embodiments, the attachment loop 90 and any associated strap member 110 are color-coded so that the person 20 knows which attachment loops 90 to use for particular exercises. For example, the two attachment loops 90 closest to the front end 81 of each shoe 80 may be colored red, which in separate instructions (not shown) may indicate that such attachment loops 90 are used for exercises requiring flexion of the ankle and exercising of the calve and shin muscles, such as track workouts, box jumps, wide receiver routes, plyometric exercise, and the like. Alternately, the rear-most attachment loops 90 may be colored blue, which in separate instructions (not shown) may indicate that such attachment loops 90 are used for exercises requiring quick change of direction movement, such as quarter back drills, basketballs drills, so-called "three-cone" drills, and the like.

Preferably a rigid metal or plastic ring 130 traverses the connection loop 60 of each belt extension strap 40 for facilitating the connection of the connection loop 60 with any of the elastomeric bands 100. In some embodiments, such a rigid ring 130 may also be included traversing one or more of the attachment loops 90 of each shoe 80.

In some embodiments the belt 30 further includes a buckle cover 210 (FIG. 7) having the hook-type fastening material 170 on an inside surface 214 thereof and adapted for fixing with the belt 30 to cover the buckle mechanism 35. Such a buckle cover 210 further includes the loop-type fastening material on an outside surface 216 thereof, such that each belt extension strap 40 may be fixed with the belt 30 at the buckle cover 210, either on the inside surface 34 or on the outside surface 36 of the belt 30 separately, or on both surfaces 34,36 as shown with a folding buckle cover 210. Without such a buckle cover 210, the belt extensions straps 40 would not be easily affixed to the belt 30 at the location of the buckle mechanism 35 if such a location for one of the belt extension straps 40 was desired.

Figure 12:
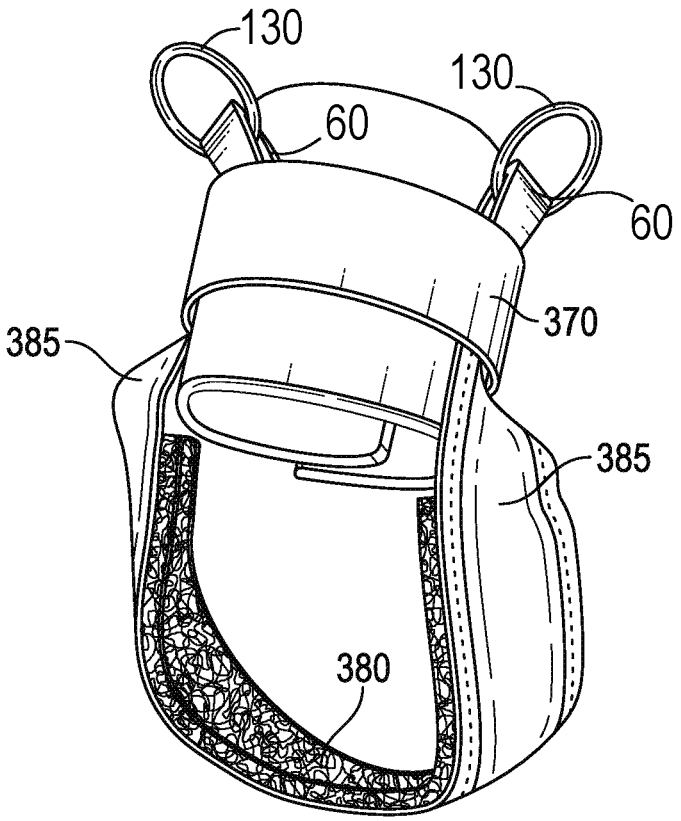
FIG. 12 is a perspective view of one embodiment of a foot strap of the invention.

Preferably at least one appendage strap 370 is fixable around one of the person's appendages, such as an ankle or wrist. Each appendage strap 370 has at least one of the connection loops 60 and rigid rings 130 fixed therewith, such that one of the elastomeric bands 100 may be fixed with the connection loop 60 of any of the at least one appendage strap 370. As with the extension strap 400, the appendage strap 370 includes the loop-type fastening material 160 on both sides, except for one end that has the hook-type fastening material 170, so that the appendage strap may be easily secured around the person's arm, wrist, leg, ankle, or the like. In some embodiments the appendage strap 370 further includes a foot strap 380 fixed at opposing ends 385 thereof to opposing sides of the appendage strap 370 (FIG. 12). When used with the at least one appendage strap 370 fixed to the person's wrist, and with at least one of the elastomeric bands 100 fixed between the appendage strap 370 and either the shoulder harness 300, the belt 30, or one of the shoes 80, the person 20 performs resistance exercises by stretching the elastomeric band 100 by extending his arm.

Figure 13:
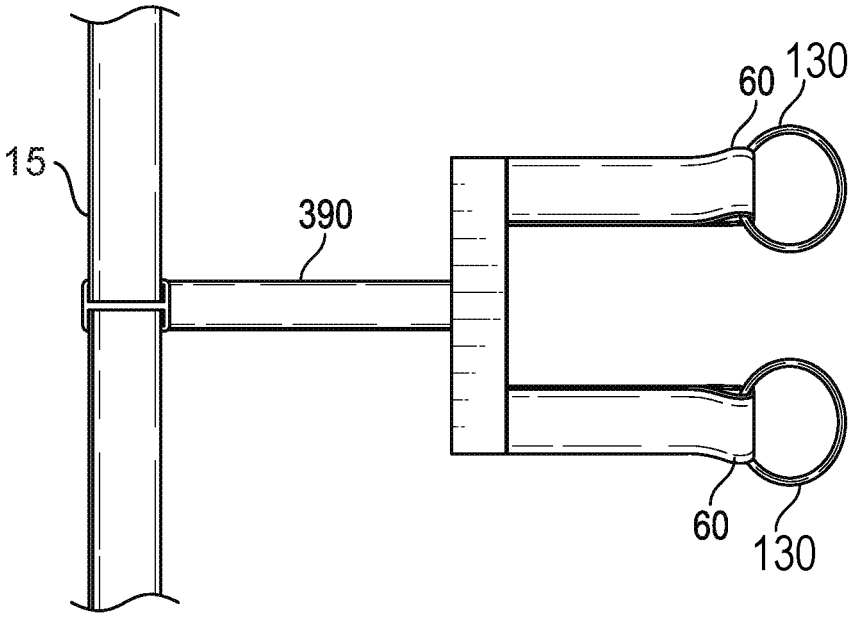
FIG. 13 is a top plan view of an object strap of the invention, illustrated as fastened to an object.

An object strap 390 (FIG. 13) may be included for fixing to an object 15, such as a pole or the like. Such an object strap 390 has at least one of the connect loops 60, such that the person 20 can attach one of the elastomeric bands 100 between the belt 30 or the shoulder harness 300 and the object 15 to perform exercises.

Figure 15:
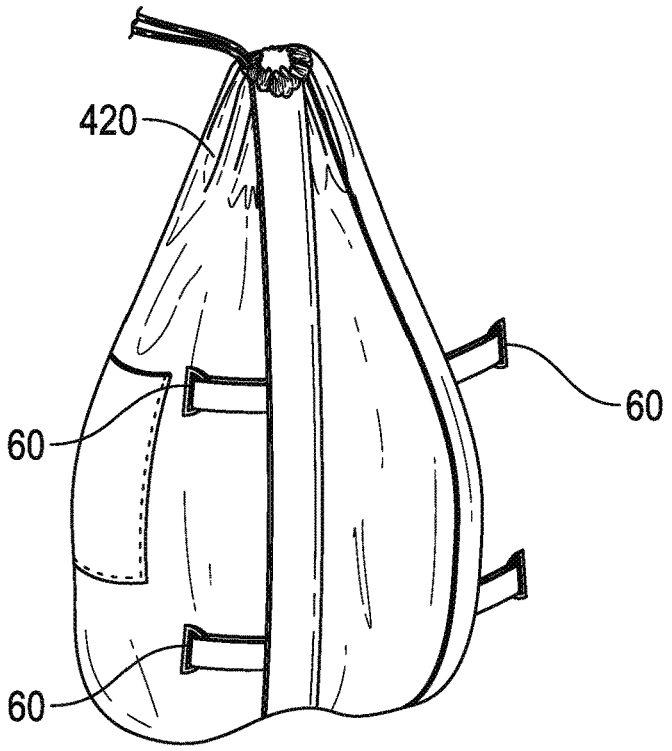
FIG. 15 is a perspective view of a container of the invention that takes the form of a backpack having a plurality of the connection loops included thereon.

In some embodiments a container 410 (FIG. 14) is included for holding items 18, such as unused elastomeric bands 100 and weights 19. As such the person 20 can attach one or more of the elastomeric bands between the belt 30, the shoulder harness 300, or one of the shoes 80 and the container 410 to perform exercise by dragging the container 410 along the ground surface 14. In some embodiments the container 410 takes the form of a backpack 420 (FIG. 15) adapted for holding the items 18, the backpacking including at least one of the connection loops 60 and rigid rings 130, such that the person 20 can attach one of the elastomeric bands 100 between the backpack 420 and the belt 30, shoulder harness 300, appendage strap 370, or one of the shoes 80 to perform exercises. When the physical training system 10 is not in use, the components can be stored in the backpack 420 and conveniently carried.

Figure 16:
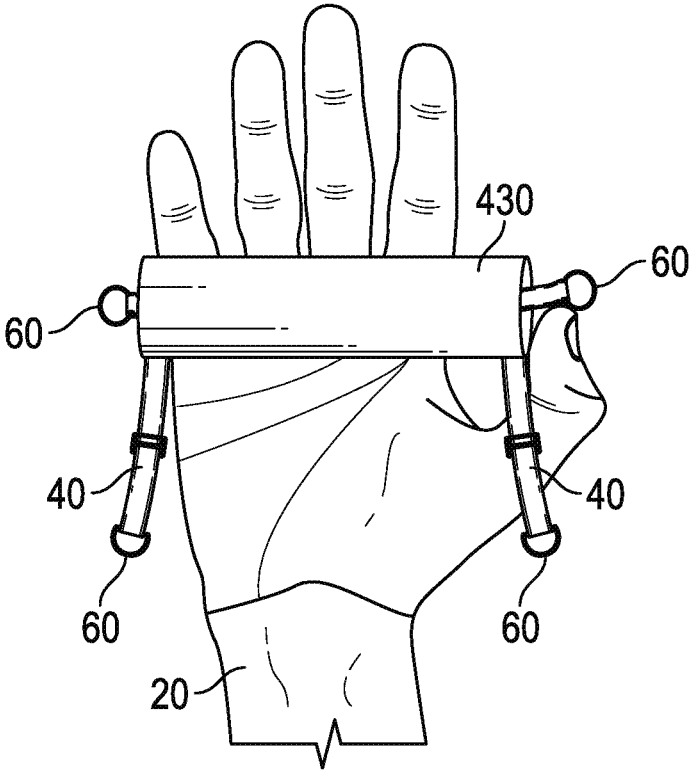
FIG. 16 is a perspective view of a hand strap of the invention.

A hand strap 430 (FIG. 16) or handle may be included for holding by the person 20, the handle strap 430 having at least one of the connection loops 60 and rigid rings 130 for attaching to one of the elastomeric bands 100. As such the person 20 can exercise by connecting at least one of the elastomeric bands 100 between the handle strap 430 and belt 30, shoulder harness 300, appendage strap 370, or one of the shoes 80 to perform resistance exercises with his arms and legs.

Figure 6:
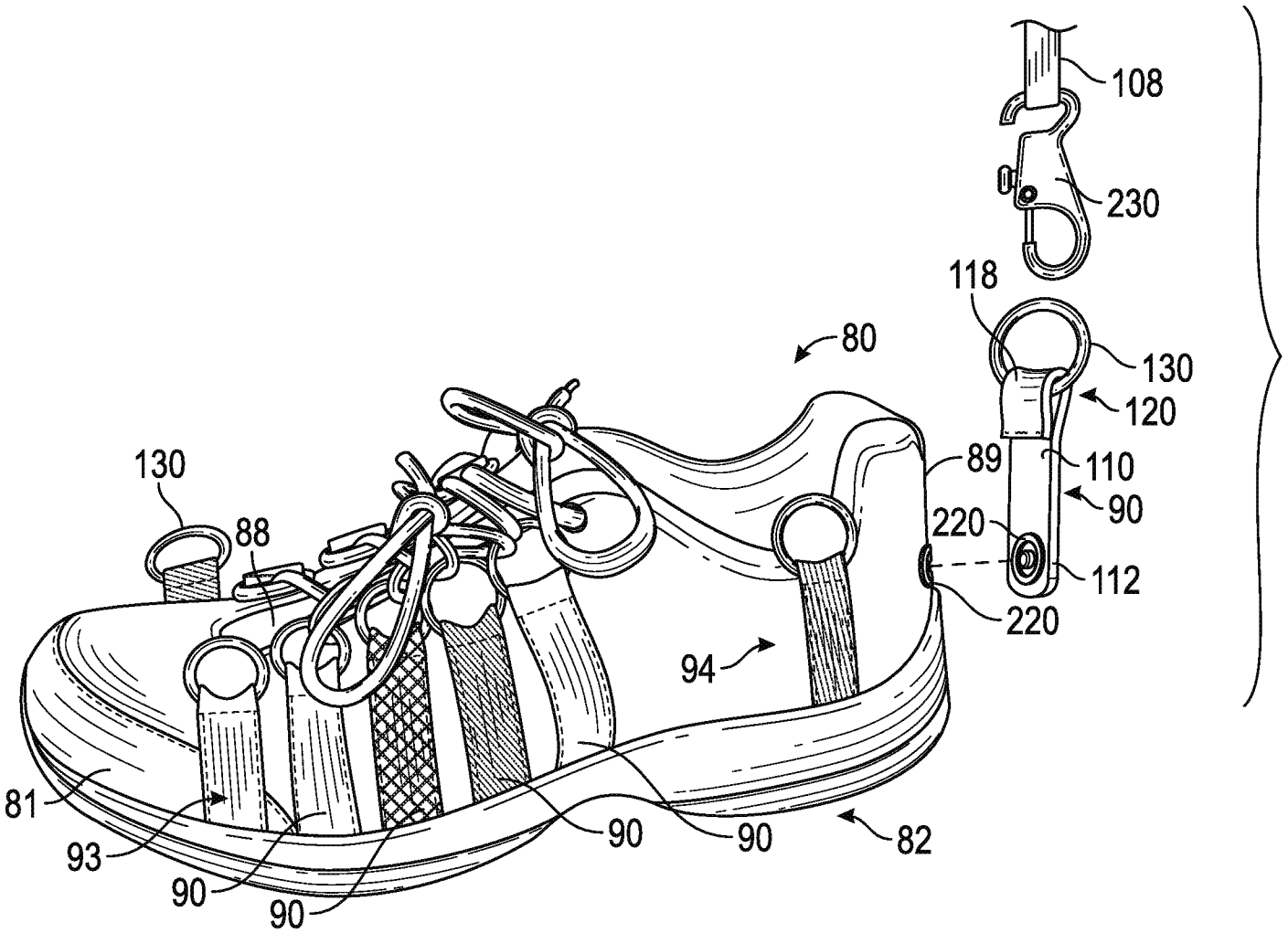
FIG. 6 is an exploded perspective view of one of the shoes of the invention.

Preferably each end 102,108 of the elastomeric bands 100 includes a selectively removable hook 230 (FIG. 6) adapted for fixing with any of the attachment loops 90 of the shoes, the connection loops 60 and rigid rings 130 of the belt extension straps 40, the connection loops and rigid rings 130 of the shoulder harness 300, or the upper ends 148 of the shoe extension straps 140. It is understood that either end 102,108 of the elastomeric bands 100 may be attached with any of the attachment loops 90, connection loops 60, rigid rings 130, or shoe extension straps 140; that is, the orientation of the elastomeric bands 100 does not affect how the physical training system 10 is used.

While a particular form of the invention has been illustrated and described, it will be apparent that various modifications can be made without departing from the spirit and scope of the invention. For example, the buckle mechanism 35 of the belt 30 may be any other conventional belt mechanism as is known in the art and, while not as convenient to use as that described herein, would also function adequately to maintain the connection loops 60 at the height of the person's hips or waist 25. Likewise, various materials, colors and appearances of shoes 80 could be utilized as is known in the art. Similarly, any of the connection loops 60 described herein may include the rigid rings 130 or not, or may include a carabiner clip (not shown), D-ring (not shown), or other clip or attachment device as is known in the art. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention. The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A physical training system for use by a person, comprising:

a belt adapted for fixing around the waist of the person and including a plurality of belt extension straps each having a belt connecting mechanism at a top end thereof and a connection loop at a bottom end thereof, each belt extension strap adapted for fixing with the belt at any location therearound and including a length adjustment mechanism adapted for allowing the length of the belt extension strap to be selectively adjusted;

two shoes adapted for wearing on the person's feet, each shoe including an outer side, an inner side, a rear end, a front end, a top side, and a bottom side, the shoe including at least four attachment loops, including an inner/front attachment loop attached with the shoe proximate the front end of the shoe on the inner side, an inner/rear attachment loop attached with the shoe proximate the rear end of the shoe on the inner side, an outer/front attachment loop attached with the shoe proximate the front end of the shoe on the outer side, and an outer/rear attachment loop attached with the shoe proximate the rear end of the shoe on the outer side;

a plurality of elastomeric bands each having a first end and a second end, the first end being selectively fixable with the connection loop of any of the belt extension straps, the second end being selectively fixable with any of the attachment loops of the shoes;

a shoulder harness having a pair of shoulder straps each connectable with the belt at opposing ends of the shoulder strap, each shoulder strap having at least one connection loop;

wherein the belt includes a loop-type fastening material on both an inside surface and an outside surface thereof, and a cooperative hook-type fastening material on an inside surface thereof at opposing first and second ends, the belt including a buckle mechanism adapted to receive the first and second ends of the belt therethrough, and wherein the belt connecting mechanism at the top end of each belt extension strap includes a hook-type fastening material on an inside surface thereof adapted for fixing about the loop-type fastening material on the inside surface and on the outside surface of the belt to fix the belt extension strap at a desired location on the belt;

whereby with the person wearing the belt, shoulder harness, and shoes, and with the plurality of elastomeric bands stretched between the connection loops of the belt extension straps, shoulder harness, and/or the attachment loops of the shoes, the person while walking or running experiences resistance as each leg extends into a fully extended position, and experiences a reduction or cessation of resistance as each leg retracts into a non-extended position.

2. The physical training system of claim 1 wherein each attachment loop of each shoe includes a strap member fixed at a lower end thereof with the shoe and terminating at an upper end in a loop, each loop adapted for selective fixing with second end of any of the elastomeric bands.

3. The physical training system of claim 2 further including a rigid ring traversing each loop of each strap member, each rigid ring adapted for fixing with the second end of any of the elastomeric bands.

4. The physical training system of claim 1 further including a plurality of shoe extension straps each fixable at an upper end thereof with the second end of any of the plurality of elastomeric bands, and selectively fixable at a lower end thereof with any of the attachment loops of either shoe.

5. The physical training system of claim 4 wherein each end of each elastomeric band includes a selectively removable hook adapted for fixing with any of the attachment loops of the shoes, any of the connection loops of the belt extension straps, any of the upper ends of the shoe extension straps, and any of the connection loops of the shoulder harness.

6. The physical training system of claim 4 wherein a short shoe extension strap is fixed with either the front end or the rear end of the shoe and a long shoe extension strap is fixed with the opposing end of the shoe, whereby when the person is walking the elastomeric bands connected to the short shoe extension straps excerpt more force on one end of the shoe than do the long shoe extension straps on another end of the shoe, whereby the person is encourage to land each foot on a ground surface at the balls of his feet or at the heel of his feet.

7. The physical training system of claim 1 wherein the belt further includes at least two hip pads, each hip pad having at least one vertical slot adapted for receiving the belt therethrough, whereby with the belt inserted into the at least one slot the hip pad may be adjusted to any location around the belt to cushion forces pulling down on the belt onto the person's hips.

8. The physical training system of claim 1 wherein the plurality of elastomeric bands includes elastomeric bands having at least two different elasticities and/or lengths, each different elasticity and/or length being indicated by an indicia or unique color.

9. The physical training system of claim 1 wherein each belt extension further includes a rigid ring traversing each connection loop of each belt extension strap, each rigid ring adapted for fixing with the first end of any of the elastomeric bands.

10. The physical training system of claim 1 wherein each belt extension strap further includes an auxiliary tension ring fixed therewith, such that external lateral forces may be applied to the auxiliary tension ring to further enhance the physical training of the person.

11. The physical training system of claim 1 wherein the belt further includes a buckle cover having the hook-type fastening material on an inside surface thereof and adapted for fixing with the belt to cover the buckle mechanism, and wherein the buckle cover further includes the loop-type fastening material on an outside surface thereof, whereby each belt extension strap may be fixed with the belt at the buckle cover.

12. The physical training system of claim 1 wherein each end of each elastomeric band includes a selectively removable hook adapted for fixing with any of the attachment loops of the shoes, any of the connection loops of the belt extension straps, and any of the connection loops of the shoulder harness.

13. The physical training system of claim 1 wherein each shoulder strap further includes at least one shoulder pad having at least one slot formed therethrough for receiving the shoulder strap therethrough, the at least one shoulder pad being adjustably positioned along the shoulder strap.

14. The physical training system of claim 1 further including at least one set of position straps, each position strap adapted to be fixed at any location along either one of the shoulder straps or the belt to indicate a proper adjustment position of one of the shoulder straps or the belt for the person, each set of position straps colored uniquely for each person sharing the physical training system.

15. The physical training system of claim 1 wherein at least one of the belt extension straps is fixed to a belt extension fastener that is adapted for fixing with the belt, the length of the belt extension strap sufficient to loop around one side of the belt to present a first length to the person, and when not looped around the belt presenting a second length to the person.

16. The physical training system of claim 1 wherein at least one of the attachment loops is an elastic attachment loop.

17. The physical training system of claim 1 further including at least one appendage strap fixable around one of the person's appendages and having at least one connection loop fixed therewith, such that one of the elastomeric bands may be fixed with the attachment loop of any of the at least one appendage strap.

18. The physical training system of claim 17 wherein the at least one appendage strap further includes a foot strap fixed at opposing ends thereof to opposing sides of the appendage strap.

19. The physical training system of claim 1 further including at least one object strap adapted for fixing to an object, the object strap having at least one connection loop, whereby the person can attach one of the elastomeric bands between the belt or the shoulder harness and the object to perform exercises.

20. The physical training system of claim 19 wherein the object is a container adapted for holding items, whereby the person can attach one of the elastomeric bands between the belt, the shoulder harness, or shoe and the container to perform exercises with the container.

21. The physical training system of claim 20 wherein the container takes the form of a backpack adapted for holding items, whereby the person can attach one of the elastomeric bands between the belt, the shoulder harness, or shoe and the backpack to perform exercises with the backpack.

22. The physical training system of claim 1 further including at least one hand strap adapted for holding by the person, the at least one hand strap having at least one of the connection loops for attaching to one of the elastomeric bands.

* * * * *